US006033553A

United States Patent [19]

Bennett

[11] Patent Number: 6,033,553

[45] Date of Patent: Mar. 7, 2000

[54] CATHODIC PROTECTION SYSTEM

[76] Inventor: Jack E. Bennett, 10039 Hawthorne Dr., Chardon, Ohio 44024

[21] Appl. No.: 09/236,731

[22] Filed: Jan. 25, 1999

Related U.S. Application Data

[63] Continuation-in-part of application No. 08/839,292, Apr. 17, 1997, which is a continuation-in-part of application No. 08/731,248, Oct. 11, 1996, abandoned.

[51] Int. Cl.[7] ..... C23F 13/00

[52] U.S. Cl. ..... 205/730; 205/730; 205/731; 205/732; 205/734; 205/735; 204/196.1; 204/196.21; 204/196.23; 204/196.36

[58] Field of Search ..... 205/724, 730–739; 204/196.01, 196.1, 196.23, 196.24, 196.25, 196.21, 196.36, 196.37

[56] References Cited

U.S. PATENT DOCUMENTS

| | | | |
|---|---|---|---|
| 4,506,485 | 3/1985 | Apostolos | 204/196.37 |
| 5,141,607 | 8/1992 | Swiat | 205/734 |
| 5,183,694 | 2/1993 | Webb | 205/734 |
| 5,505,826 | 4/1996 | Haglin et al. | 205/731 |

*Primary Examiner*—T. Tung
*Attorney, Agent, or Firm*—Tarolli, Sundheim, Covell, Tummino & Szabo L.L.P.

[57] ABSTRACT

The present invention relates to the field of cathodic protection of reinforced concrete. A conductive metal is thermally applied onto an exposed surface of the concrete in an amount effective to form an anode on the surface. This establishes an interface between the anode and the concrete. The thermal application is performed in a manner which is effective to impart permeability to the anode. A lithium salt solution selected from the group consisting of lithium nitrate solution, lithium bromide solution, and combinations thereof is applied to the external surface of the anode. The solution migrates by capillary attraction to the interface of the anode with the concrete depositing the lithium salt at the interface. The lithium salt functions as a current enhancing agent. The salt also functions as a humectant absorbing moisture from the atmosphere thereby providing an electrolyte at the interface. These combined effects substantially increase current delivery from the anode.

19 Claims, 2 Drawing Sheets

CATHODIC PROTECTION SYSTEM

This application is a continuation-in-part of prior application Ser. No. 08/839,292 filed Apr. 17, 1997, which in turn was a continuation-in-part of parent application Ser. No. 08/731,248 filed Oct. 11, 1996, now abandoned.

BACKGROUND OF THE INVENTION

1. Technical Field

This invention relates generally to the field of cathodic protection systems for steel-reinforced concrete structures, and is particularly concerned with the performance of cathodic protection systems utilizing thermally sprayed zinc, zinc alloy, or aluminum anodes.

2. Description of the Prior Art

The problems associated with corrosion-induced deterioration of reinforced concrete structures are now well understood. Steel reinforcement has generally performed well over the years in concrete structures such as bridges, buildings, parking structures, piers, and wharves, since the alkaline environment of concrete causes the surface of the steel to "passivate" such that it does not corrode. Unfortunately, since concrete is inherently somewhat porous, exposure to salt results in the concrete over a number of years becoming contaminated with chloride ions. Salt is commonly introduced to the concrete in the form of seawater, set accelerators or deicing salt.

When the chloride contamination reaches the level of the reinforcing steel, it destroys the ability of the concrete to keep the steel in a passive, or non-corrosive state. It has been determined that a chloride concentration of 0.6 Kg per cubic meter of concrete is a critical value above which corrosion of steel can occur. The products of corrosion of the steel occupy 2.5 to 4 times the volume of the original steel, and this expansion exerts a tremendous tensile force on the surrounding concrete. When this tensile force exceeds the tensile strength of the concrete, cracking and delaminations develop. With continued corrosion, freezing and thawing, and traffic pounding, the utility or the integrity of the structure is finally compromised and repair or replacement becomes necessary. Reinforced concrete structures continue to deteriorate at an alarming rate today. In a recent report to Congress, the Federal Highway Administration reported that of the nation's 577,000 bridges, 226,000 (39% of the total) were classified as deficient, and that 134,000 (23% of the total) were classified as structurally deficient. Structurally deficient bridges are those that are closed, restricted to light vehicles only, or that require immediate rehabilitation to remain open. The damage on most of these bridges is caused by corrosion of reinforcing steel. The United States Department of Transportation has estimated that $90.9 billion will be needed to replace or repair the damage on these existing bridges.

Many solutions to this problem have been proposed, including higher quality concrete, improved construction practices, increased concrete cover over the reinforcing steel, specialty concretes, corrosion inhibiting admixtures, surface sealers, and electrochemical techniques such as cathodic protection and chloride removal. Of these techniques, only cathodic protection is capable of controlling corrosion of reinforcing steel over an extended period of time without complete removal of the salt contaminated concrete.

Cathodic protection reduces or eliminates corrosion of the steel by making it the cathode of an electrochemical cell. This results in cathodic polarization of the steel, which tends to suppress oxidation reactions (such as corrosion) in favor of reduction reactions (such as oxygen reduction). Cathodic protection was first applied to a reinforced concrete bridge deck in 1973. Since then, understanding and techniques have improved, and today cathodic protection has been applied to over one million square meters of concrete structure worldwide. Anodes, in particular, have been the subject of much attention, and several types of anodes have evolved for specific circumstances and different types of structures.

One type of anode which has recently been utilized for cathodic protection of reinforced concrete structures is thermally-sprayed zinc or zinc alloy. In this case thermal energy is used to convert a zinc or zinc alloy to its molten or semi-molten state, which is then deposited onto a prepared substrate. The zinc or zinc alloy may originally be in the form of powder, wire or rod. Thermal energy is generated by using combustible gases or an electric arc. As the zinc or zinc alloy is heated, it changes to a molten or plastic state, and is then accelerated by a compressed gas to the substrate surface. The particles strike the surface where they conform and adhere to the irregularities of the prepared surface and to each other. As the sprayed particles continue to impinge upon the substrate, they cool and build up, particle by particle, thus forming a coating. It has been determined in a recent survey that zinc anodes have been utilized for cathodic protection on 50,000 square meters of reinforced concrete structures.

This zinc or zinc alloy coating may then be used as an anode to supply current for the cathodic protection process. Such anodes may be used for either sacrificial or impressed current cathodic protection systems. Sacrificial cathodic protection systems are simpler and less expensive to install and maintain than impressed current systems, first because an ancillary power supply is not needed, and also because intentional shorts between the anode and steel are not detrimental to the system. For sacrificial systems a direct electrical connection is made between the anode and the reinforcing steel, and current flows spontaneously since the electrochemical reactions which cause current flow are thermodynamically favored. The amount of current which flows is uncontrolled, and is dependent mainly on the resistance of the concrete, the geometric relationship between the anode and steel, and the age of the system. The current which flows from sacrificial systems is sometimes insufficient to meet cathodic protection criteria. For this reason, the use of sacrificial systems is usually limited to locations where the concrete is very conductive due to high moisture and chloride content, such as in the seawater splash and tidal zone. Even so, cathodic protection systems utilizing zinc or zinc alloy anodes always experience a current decrease with time. After a few months, or at most, a very few years, current flow will decrease to the point where it is insufficient to meet cathodic protection criteria, at which point the anode will have to be removed and replaced. Removal and subsequent replacement of the anode by thermal spray process involves significant expense.

Where zinc and zinc alloy anodes are used in impressed current systems, a power supply is connected between the anode and the reinforcing steel. The power supply is used to increase the driving force (voltage) between the anode and cathode. In this case, the voltage may be increased so that the current needed for cathodic protection is maintained for a much longer period of time. Even so, after a few years the cathodic protection system voltage may exceed the design maximum of the power supply, usually 24 volts, and the current will thereafter become insufficient to meet cathodic protection criteria. This phenomenon of declining current from zinc and zinc alloy anodes has been a major limitation for the use of zinc and zinc alloy anodes, both for sacrificial and for impressed current cathodic protection systems. The exact cause of this phenomenon is not known, but is generally thought to be related to the build-up of anode corrosion products, such as zinc oxides and hydroxides, at the interface between the anode and the concrete.

SUMMARY OF THE INVENTION

The present invention relates to a method of cathodic protection of reinforced concrete, and more particularly, to a method of increasing current delivery from an anode used in a cathodic protection system.

The method of the present invention comprises thermally applying a conductive metal onto an exposed surface of the concrete in an amount effective to form a planar anode bonded to the surface. The anode and concrete have an interface. The thermal application of the conductive metal is performed in a manner which is effective to obtain an anode which is permeable. Preferably, the anode has a porosity of at least 10%. Preferred conductive metals for the anode are zinc, a zinc alloy, or an aluminum alloy.

A lithium salt solution selected from the group consisting of a lithium nitrate ($LiNO_3$) solution, a lithium bromide (LiBr) solution, and combinations thereof, is applied to the external surface of the anode after the metal of the anode has been thermally applied to the concrete. The lithium salt solution quickly and effectively migrates through the pores of the permeable anode to the interface between the anode and the concrete. The lithium salt at the interface functions as a current enhancing agent. The salt also functions as a humectant absorbing moisture from the atmosphere thereby providing an electrolyte at the interface. These combined effects substantially increase current delivery from the anode.

The lithium salt solution preferably comprises a surfactant which wets the exposed surface of the metal anode and facilitates migration of the solution through the anode to the interface of the anode with the concrete.

Preferably, enough lithium salt solution is applied to the external surface of the anode to position at the interface of the anode and the concrete structure at least 10 grams of lithium salt, dry basis, per square meter of anode.

Preferably, the metal anode has a thickness which is less than about 20 mils (0.5 mm).

BRIEF DESCRIPTION OF THE DRAWINGS

Further features of the present invention will become apparent to those skilled in the art to which the present invention relates from reading the following specification with references to the accompanying drawings, in which.

DESCRIPTION OF PREFERRED EMBODIMENTS

Figure 1:
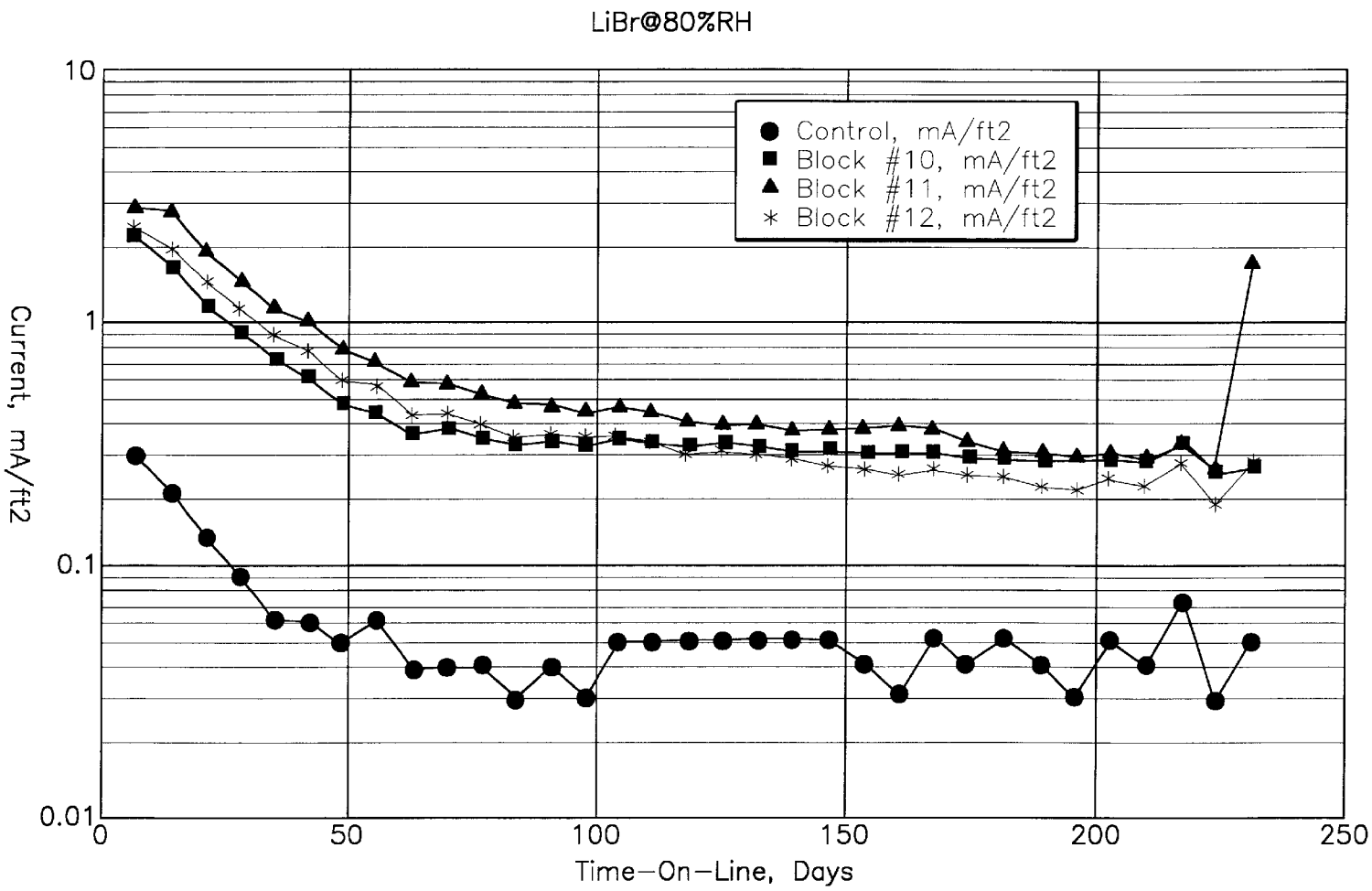
FIG. 1 is a graph showing the current delivered plotted against days run for metallized zinc anodes applied to three reinforced concrete blocks, the anodes having been treated with a concentrated solution of lithium bromide in accordance with the present invention, compared with a control specimen not so treated, each maintained at 80% relative humidity and a temperature of 21° centigrade.

The present invention relates broadly to all reinforced concrete structures with which cathodic protection systems are useful.

Generally, the reinforcing metal in a reinforced structure is steel. However, other ferrous based metals can also be used.

The cathodic protection system of the present invention comprises at least one anode at a surface of the concrete structure. Multiple anodes at spaced intervals are commonly used.

Each anode is connected by a suitable conductor to the reinforcement of the concrete structure.

The cathodic protection system can be an impressed current system or a sacrificial cathodic protection system.

In an impressed current system, a power supply is positioned in the connection between the anode and the concrete reinforcement. The power supply provides an impressed flow of electrical current between the anode and the reinforcement. The impressed current flow is opposite and essentially equal to that which naturally occurs in a reinforced structure which has no cathodic protection, thus "passivating" the reinforcement. The net result is very little or no electrolytic action on the reinforcement, and little or no corrosion of the reinforcement occurs.

In a sacrificial cathodic protection system, corrosion of the anode is relied upon for current flow instead of an external source of current flow. No power supply is used. The current flows spontaneously since the electrochemical reactions which cause current flow are thermodynamically favored.

A preferred metal for the metal anodes is zinc, a zinc alloy, or an aluminum alloy. These are sacrificial materials, but they can be used in both sacrificial cathodic protection systems and impressed current systems. A non-sacrificial material that has been used in impressed current systems is titanium or a titanium alloy.

Preferably, the metal anode is thermally applied to the reinforced structure. Details of such thermal application are disclosed in U.S. Pat. No. 4,506,485. The disclosure of this patent is incorporated herein by reference.

More preferably, the metal anode is applied by a thermal spray process such as combustion (flame) spraying or electric arc spraying. Combustion spraying and electric arc spraying are cost-effective methods for application of cathodic protection anodes to field structures and are preferred.

When the metal of the metal anode is applied to a concrete surface, it forms an interface with the concrete surface. The molten particles of metal from the thermal application process flow into irregularities in the concrete surface. On solidification, this results in a good bond between the anode and the concrete at the concrete-anode interface.

The thermal application of metal onto the concrete surface produces an anode which has a planar configuration. In addition, the anode is permeable when applied by combustion (flame) spraying or electric arc spraying. Preferably, the anode has a porosity of at least about 10%. Obtaining a porosity of greater than 10% depends upon the coating process which is used and such parameters as distance between the spray gun and concrete. Such coating processes as plasma spraying, detonation gun spraying and high-velocity oxyfuel (HVOF) spraying will normally produce a coating which is too dense. The techniques for increasing or decreasing porosity, such as adjusting the spray distance to the substrate being coated, are well known and described in the literature.

In the metal coating art, the "porosity" is determined by microscopically measuring the void area relative to the total area of a coating in cross-section. It is understood that the pores in the coating are interconnected, providing coating permeability.

Preferably, the thickness of the anode on the concrete structure is limited to less than about 20 mils (0.5 mm). A lithium salt solution selected from the group consisting of lithium nitrate ($LiNO_3$) solution, lithium bromide (LiBr) solution, and combinations thereof, is applied to the exposed surface of the anode. For purposes of the present application, the term "solution" includes dispersions and suspensions. A preferred liquid medium for the lithium salt is water, although other solvents in which the lithium salts are soluble or dispersible can also be used. The pores within the anode are small, but are of sufficient diameter to permit the passage of the solutions, dispersions or suspensions of a lithium salt to the anode-concrete interface by capillary attraction.

Alternatively, the lithium nitrate or lithium bromide may be dissolved in an organic solvent, such as alcohol, for application to the surface of the anode, followed by transport to or near the interface between the anode and the concrete by capillary action.

The lithium nitrate or lithium bromide may also be applied in solution or in solid form to the concrete surface prior to application of the anode metal to the concrete surface, but the preferred method of application is in an aqueous solution to the external surface of the thermally sprayed anode, as this method avoids any interference with the formation of the anode-concrete bond.

Lithium bromide was found to be the more effective of the two agents, but lithium bromide may also contribute slightly to non-faradic corrosion of the metal anode. For this reason, it may be advantageous to add about 1,000 parts per million (PPM) of lithium nitrate as a corrosion inhibitor to the lithium bromide solution when the latter is used.

The lithium salt solutions can be applied by spraying, brushing, or roller coating. Other methods of application of the solutions will be apparent to those skilled in the art.

If the anode coating is thick (greater than about 20 mils), it may be advantageous to produce thin spots in the anode coating to facilitate penetration of the salt solution. This may be accomplished by drilling or abrading the anode coating in selected locations. It may also be accomplished by placing a template over the concrete substrate during the thermal application of the anode. A template in the form of a wire mesh with wires placed on four centimeter centerline spacing, for example, creates a pattern of thin areas in the anode through which the salt solution more easily penetrates. The thin areas of anode should not comprise more than about 20% of the total anode area.

The lithium salts of the present invention, once delivered to or near the interface, remain at or near the interface for a long period of time. The diffusion coefficients for such materials in concrete are small making further penetration of the lithium salts into the concrete more difficult.

If the lithium salts are, over a long period of time, eluded from the interface between the anode and the concrete, for instance by rainfall, then the salt solutions can be reapplied to the exterior surface of the anode to again deposit the lithium salts at or near the interface between the anode and the concrete. The lithium salt solutions can be reapplied as often as is necessary throughout the life of the cathodic protection system.

The principle advantage of the use of the lithium salts as taught by the present invention is that the current flow from an impressed current anode or a sacrificial anode will be enhanced.

In a sacrificial anode cathodic protection system, it is theorized that the reason for the decrease of current which flows from a metal anode used sacrificially, is an increase in electrical resistance at the interface between the anode and the concrete. It is further theorized that this increase in resistance is due to the formation of products of corrosion, principally zinc oxides and hydroxides, which are poor conductors. After significant buildup of these corrosion products, a thin layer of dry, relatively high resistivity material exists within the electrical circuit.

Although not to be held to any theory, it is believed that the lithium salts break down the passive layer of corrosion products and allow ions to flow more easily through the layer, the salts thus functioning as a current enhancing agent. The lithium salts are also humectants and absorb water from the atmosphere. Moisture is thus retained at or drawn into the interface by the lithium salts positioned at the interface. The moisture functions as an electrolyte which helps counteract the increase in electrical resistance at the interface. However the increase in current flow at the interface is greater than would be expected from the presence of moisture alone.

In an impressed current system, the buildup of corrosion products at the anode may not be a problem. However, the use of the lithium salts of the present invention at the anode-concrete interface reduces the circuit resistance and results in adequate current flow at a lower system voltage and a more uniform current flow in the area covered by the system. This has the benefits of extending system life and improving system performance.

The amount of lithium salt required at or near the interface between the anode and the concrete varies depending upon the type of reinforced concrete structure, its location, its degree of salt contamination from such sources as seawater and deicers, and other factors. Broadly, the amount of lithium salt is that amount effective to increase the current flow at the anode-concrete interface, and is relatively large compared for instance, to the amount of contaminating salt which may be present in the concrete from seawater and deicers. Preferably, the lithium salt is applied in a range from about 10 grams per square meter of anode to about 400 grams per square meter of anode, dry basis. The preferred range of lithium salt is from about 40 to 200 grams per square meter. If too little lithium salt is applied, the amount of lithium salt retained at or near the interface will be insufficient to enhance the current flow from the anode or reduce the resistivity at the interface between the anode and concrete. If too much lithium salt is applied, this will result in an additional expense for no benefit.

The concentration of lithium salt in an aqueous solution for application to the surface of a zinc or zinc alloy may range from about 20 to about 900 grams per liter. If a solution is too dilute, then a large number of coats is required to deposit the required amount of lithium salt at or near the interface between the anode and the concrete. The upper end of the range of concentration of lithium salt in the aqueous solution is limited by the solubility of the salt in water. When using an aqueous solution containing about 300 grams per liter of lithium salt, for concrete with a typical degree of dryness, about three coats of solution are required to deposit the preferred amount of salt. The application is best done using brief drying periods between coats.

The cathodic protection system of the present invention may be energized immediately after application of the lithium salt. In some instances, it may be necessary to limit the current flow from an impressed current anode following application of the lithium salt. This may be done simply by installing a variable resistor in the wire between the anode and the cathode. The resistor may then be adjusted to limit the current to that sufficient to achieve cathodic protection criteria.

Alternatively, the type and concentration of lithium salt may be chosen to effectively control the cathodic protection current delivered. For example, a low concentration of lithium salt may first be applied to increase cathodic protection current slightly to a threshold level needed to achieve protection criteria. A higher current, which may shorten the effective life of the anode, is avoided. Later in the life of the system, a higher concentration of lithium salt may be applied to increase the current again as the anode continues to age, or as a greater chloride concentration increases the current requirement. The judicious use of lithium salt in this way allows not only enhancement, but also control of current delivered from a sacrificial cathodic protection system, a benefit which was previously impossible.

It may be advantageous to add certain agents to the lithium salt solutions prior to applying the solutions to the exposed surface of a thermally applied anode.

For instance, it may be advantageous to include a wetting agent or surfactant in the lithium salt solution. The wetting agent or surfactant wets the surface of the thermally applied anode and increases the rate of diffusion of the solution through the anode to the interface of the anode with the concrete. Soaps, alcohol, fatty acids and detergents are effective wetting agents. Lysol® deodorizing cleanser and "SPRAY AND WASH" from Dow Brands, Indianapolis, Ind., were found to work well when used in an amount of about 0.2 to about 2% by volume, preferably about 1% by volume.

It may also be advantageous to decrease the diffusion of the lithium nitrate and lithium bromide away from the anode-concrete interface. This may be done by application of the lithium nitrate or lithium bromide together with a jelling agent capable of thickening the solution following placement at the anode-concrete interface. This may be accomplished by application of a hot solution, which congeals upon cooling, or by using a material which can be cross-linked following placement.

A principle advantage of the use of the lithium salts of the present invention is that the enhanced current flow in the system will continue to meet cathodic protection criteria for a much longer period of time, thus delaying the necessity to reapply the metal or metal alloy anode at frequent intervals.

It may be beneficial to deposit the lithium salt only after the cathodic protection current flow has dropped to an unacceptable level. In this way, current flow which is unnecessarily high may also be avoided.

It has been found that the lithium salts applied as taught by the present invention have an additional benefit. If a cathodic protection system utilizing a sacrificial anode such as a zinc or zinc alloy anode or a non-sacrificial anode such as a titanium anode is selectively wetted on only a portion of its surface, then current density is greatly enhanced in those wetted areas. This may cause large currents to flow in those select areas causing a high wear rate of the anode in those locations. This uneven wear rate may eventually cause the system to fail prematurely. By the use of the lithium salts as taught by the present invention, a more even distribution of current resulting in more uniform protection of the reinforcing steel and in extended service life of the cathodic protection system is achieved.

EXAMPLE I

Three newly constructed 12×9×2 inch (30.3×22.9×5.1 centimeter) concrete blocks were cast containing a mild steel expanded mesh 0.1875 inch (4.75 centimeter) thick having diamond dimensions of 1.0 inch LWD×0.5 inch SWD (2.54 centimeter LWD×1.27 centimeter SWD). The surface area of the steel mesh was about 1 square foot per square foot of top concrete surface. The mix proportions for the concrete specimens were as follows:

Type I Portland Cement—715 lb/yd$^3$

Frank Road Sand Fine Aggregate—1010 lb/yd$^3$

No. 57 American Aggregates Limestone—1830 lb/yd$^3$

Sodium chloride (NaCl)—5 lb/yd$^3$

Water—285 lb/yd$^3$

Air—6%

Following a 24-hour mold curing period, the blocks were wrapped in plastic to retain moisture for 28 days. After the 24-hour curing period, the blocks were coated on the top surface with a pure zinc anode by combustion spray using an oxy-acetylene flame. The anodes had a porosity greater than 10%. The flame gun was manipulated by robot to insure uniformity and repeatability. Zinc anode thickness was measured as 14.7 mils (0.37 millimeter), and the weight gain was recorded as 223.4 grams per square foot (2.4 kilograms per square meter).

The zinc anode surfaces were then treated with a solution containing 300 grams per liter of lithium bromide. The solution also comprised 1% by volume Lysol®. The three blocks received an average of 7.57 grams per square foot (81.45 grams per square meter) of lithium bromide (dry basis) in three coats.

The three treated blocks were then placed in a chamber in which temperature was controlled to about 21° centigrade and relative humidity was controlled to about 80%. An electrical connection was made between the zinc anode and steel mesh across a 10-ohm resistor to facilitate measurement of galvanic current. Three control specimens were prepared as above, but without application of lithium bromide solution, and the control specimens were also placed in the chamber and monitored for galvanic current flow. The results of the first 230 days of operation are shown in FIG. 1, in which galvanic current is plotted against time in days. The galvanic current in the three control blocks was averaged and is presented as a single line in FIG. 1 for simplicity. Galvanic current of all specimens decreased over the first 100 days of operation. Under these conditions, the galvanic current delivered by the blocks treated with lithium bromide was seen to be about seven (7) times that of the control blocks.

EXAMPLE II

Four newly constructed concrete blocks were cast with the same design and mix proportions as those described for Example I above. The blocks were coated with zinc on their top surfaces by combustion spray using an oxy-acetylene gun as described in Example I, giving coatings having a porosity greater than 10%. The anode surfaces of the three blocks were chemically treated with salt solutions as in Example 1 providing salt loadings as follows. The treating solutions also contained 1% by volume of Lysol®:

| BLOCK | CHEMICAL | LOADING(gm/ft$^2$) | gm/m$^2$ |
|---|---|---|---|
| 30 | None | 0.00 | 0.00 |
| 32 | Potassium acetate | 6.69 | 72 |
| 34 | Lithium nitrate | 7.13 | 76.75 |
| 36 | Lithium bromide | 7.23 | 77.83 |

The blocks were then placed in an outdoor test yard in Northeast Ohio and were subjected to ambient outdoor conditions from May 6 to Sep. 11, 1998. The blocks were covered to prevent being directly wetted by rainfall to simulate conditions under a highway bridge structure. As in Example I, an electrical connection was made between the zinc anode and steel mesh across a 10-ohm resistor to facilitate measurement of galvanic current.

Figure 2:
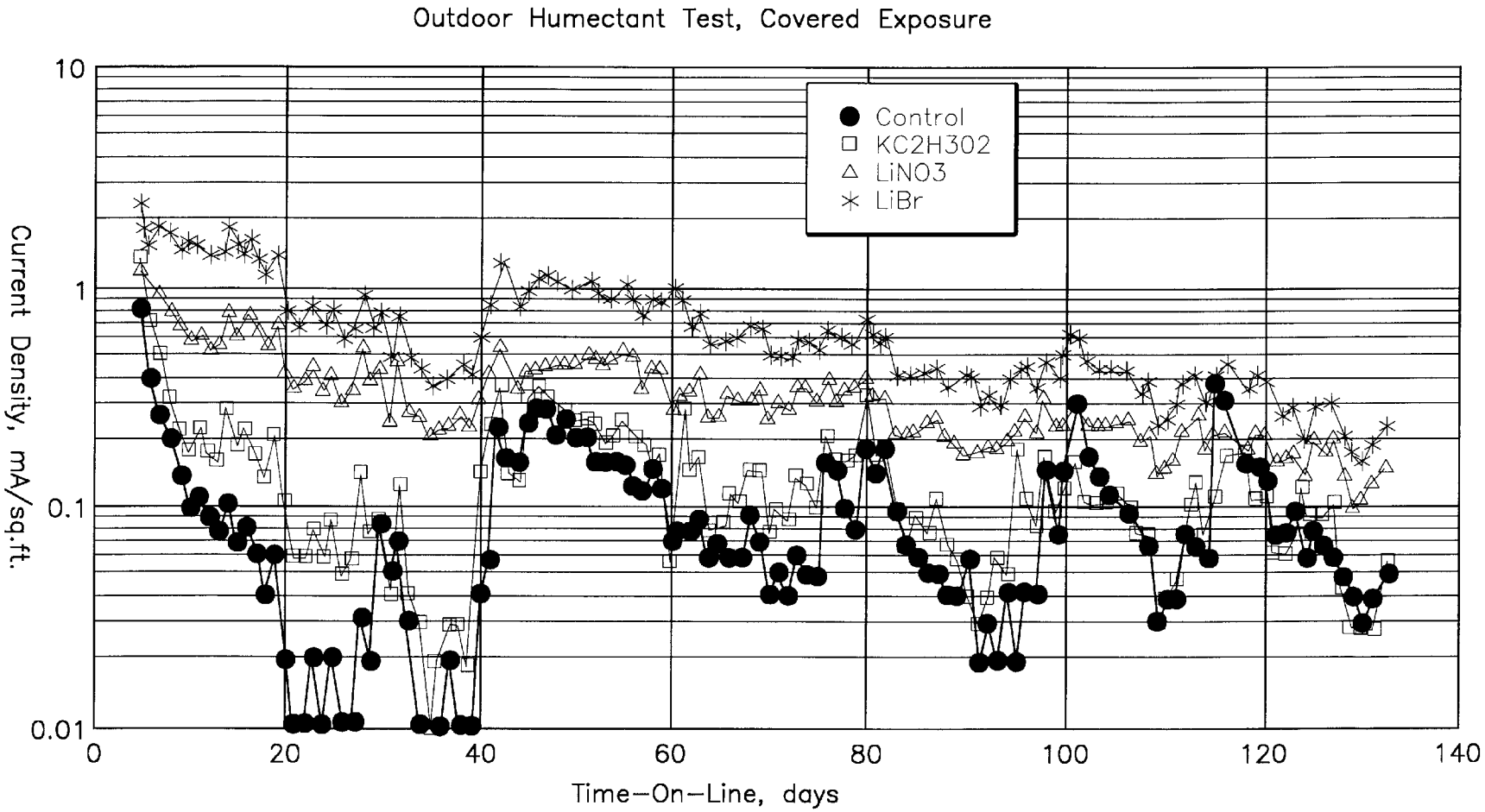
FIG. 2 is a graph showing the current delivered plotted against days run for metallized zinc anodes applied to two reinforced concrete blocks, the anodes having been treated with concentrated solutions of lithium bromide and lithium nitrate in accordance with the present invention, compared with a control specimen not so treated and a specimen treated with a concentrated solution of the humectant potassium acetate, each maintained outdoors in Northeast Ohio.

The galvanic current flow is shown against time in days on FIG. 2. Current is seen to decrease initially, due principally to very dry weather in Ohio in June 1998. During this time, galvanic current delivered by the control block went nearly to zero.

Current fluctuated throughout the summer due to local rainfall, relative humidity and temperature. Galvanic current delivery was improved for the block treated with potassium acetate, which is a very good humectant. Galvanic current delivered by the block treated with lithium nitrate was much higher than that treated with potassium acetate, and was roughly 2–10 times that of the control block. Galvanic current delivered by the block treated with lithium bromide was the highest of any tested, and was roughly 4–15 times that of the control block.

The performance of these and several other test blocks confirm the superiority of lithium nitrate and lithium bromide over many other chemicals tested.

From the above description of the invention, those skilled in the art will perceive improvements, changes and modifications. Such improvements, changes and modifications within the skill of the art are intended to be covered by the appended claims.

Having described the invention, the following is claimed:

1. A method of cathodic protection of reinforced concrete having reinforcement comprising the steps of:

(a) thermally applying a sacrificial conductive metal onto an exposed surface of the reinforced concrete in an amount effective to form a sacrificial or impressed current anode on such surface, wherein said conductive metal anode after thermal application is permeable, said conductive metal anode being bonded to the concrete surface and having an interface with the concrete surface;

(b) electrically connecting said anode to said reinforcement;

(c) applying onto the exposed surface of said conductive metal anode a lithium salt in liquid form, said lithium salt being selected from the group consisting of lithium bromide, lithium nitrate, and combinations thereof; and (d) allowing said liquid lithium salt to migrate through the pores of said conductive metal anode to said anode and concrete interface, said salt at said interface increasing the current delivery from said anode at said interface.

2. The method of claim 1 wherein said anode is zinc, a zinc alloy, or an aluminum alloy.

3. The method of claim 2 wherein said lithium salt in liquid form is an aqueous solution of said lithium salt.

4. The method of claim 3 wherein said solution comprises a wetting agent in an amount effective to wet the exposed surface of said conductive metal anode.

5. The method of claim 3 wherein the permeability of the anode is effective to position at or near the interface of the anode and concrete surface lithium salt in the amount of at least 10 grams, dry basis, per square meter of anode.

6. The method of claim 2 wherein said conductive metal anode has a porosity of at least 10%.

7. The method of claim 6 wherein said anode has an average thickness less than 20 mils.

8. The method of claim 2 wherein said thermal application is combustion spraying or electric arc spraying.

9. A liquid treating agent for application to an exposed surface of a porous conductive metal anode which has been thermally applied and is bonded to a reinforced concrete structure having reinforcement for cathodic protection of said structure wherein said anode is electrically connected to said reinforcement and has a porosity of at least 10%, which liquid agent migrates through the pores of said anode to the interface between the anode and said structure, comprising:

a lithium salt selected from the group consisting of lithium bromide, lithium nitrate, and combinations thereof;

a liquid medium for said salt; and a wetting agent present in said liquid medium in an amount effective to wet the exposed surface of said porous conductive metal anode.

10. The liquid treating agent of claim 9 wherein said liquid medium is water and said liquid treating agent is an aqueous solution.

11. The liquid treating agent of claim 10 having a lithium salt concentration of 20 to 900 grams per liter.

12. A reinforced concrete structure having reinforcement comprising:

a) a surface;

b) a sacrificial planar conductive metal anode at said surface, said anode comprising an exposed anode surface and being permeable, said anode being bonded to said concrete structure surface and having an interface with said concrete structure surface;

c) an electrical connection between said anode and the reinforcement of said structure; and d) a lithium salt selected from the group consisting of lithium bromide, lithium nitrate, and combinations thereof at or near said interface in an amount effective to increase the current delivery from said anode.

13. The structure of claim 12 wherein said lithium salt is present at said interface in the amount of at least 10 grams, dry basis, per square meter of anode.

14. The structure of claim 13 wherein said anode is zinc, a zinc alloy, or an aluminum alloy.

15. The structure of claim 12 prepared by the method comprising the steps of:

(a) thermally applying a sacrificial conductive metal onto an exposed surface of the reinforced concrete in an amount effective to form a sacrificial or impressed current anode on such surface, wherein said conductive metal anode after thermal application is permeable, said conductive metal anode being bonded to the concrete surface and having an interface with the concrete surface;

(b) subsequently applying onto the exposed surface of said conductive metal anode a lithium salt in liquid form, said lithium salt being selected from the group consisting of lithium bromide, lithium nitrate, and combinations thereof; and (c) allowing said liquid lithium salt to migrate through the pores of said conductive metal anode to said anode and concrete interface, said salt at said interface increasing the current delivery from said anode at said interface.

16. A method of cathodic protection of reinforced concrete having reinforcement and a thermally applied sacrificial conductive metal anode on an exposed surface of the reinforced concrete, wherein said conductive metal anode is electrically connected to said reinforcement, is permeable, is bonded to the concrete surface, and has an interface with the concrete surface, comprising the steps of:

(a) applying onto an exposed surface of said conductive metal anode a lithium salt in liquid form, said lithium salt being selected from the group consisting of lithium bromide, lithium nitrate, and combinations thereof;

(b) allowing said liquid lithium salt to migrate through the pores of said conductive metal anode to said anode and concrete interface, said salt at said interface increasing the current delivery from said anode at said interface.

17. The method of claim 16 wherein said anode has a porosity of at least 10% and said lithium salt in liquid form is an aqueous solution of said lithium salt.

18. The method of claim 17 wherein said anode has an average thickness less than about 20 mils.

19. The method of claim 18 wherein the permeability of the anode is effective to position at or near the interface of the anode and concrete surface lithium salt in the amount of at least 10 grams, dry basis, per square meter of anode.

* * * * *

UNITED STATES PATENT AND TRADEMARK OFFICE

CERTIFICATE OF CORRECTION

PATENT NO. : 6,033,553
DATED : March 7, 2000
INVENTOR(S) : Jack E. Bennett

It is certified that error appears in the above-identified patent and that said Letters Patent is hereby corrected as shown below:

Column 10,
Line 47, change "13" to -- 12 --

Signed and Sealed this

Twenty-fifth Day of December, 2001

*Attest:*

*Attesting Officer*

JAMES E. ROGAN
*Director of the United States Patent and Trademark Office*